United States Patent [19]

Jautelat et al.

[11] Patent Number: 4,781,163

[45] Date of Patent: Nov. 1, 1988

[54] FUEL INJECTION SYSTEM

[75] Inventors: Rüdiger Jautelat, Tamm; Rolf Kohler, Schwieberdingen; Günther Plapp, Filderstadt; Botho Zichner, Schwieberdingen, all of Fed. Rep. of Germany; Hans-Martin Muller, Framington Hills, Mich.

[73] Assignee: Robert Bosch GmbH, Stuttgart, Fed. Rep. of Germany

[21] Appl. No.: 90,246

[22] PCT Filed: Sep. 19, 1986

[86] PCT No.: PCT/DE86/00380

§ 371 Date: Jul. 20, 1987

§ 102(e) Date: Jul. 20, 1987

[87] PCT Pub. No.: WO87/03337

PCT Pub. Date: Jun. 4, 1987

[30] Foreign Application Priority Data

Nov. 26, 1985 [DE] Fed. Rep. of Germany ..... 3541731

[51] Int. Cl.[4] ..... F02M 51/02

[52] U.S. Cl. ..... 123/492; 123/493; 123/489

[58] Field of Search ..... 123/492, 493, 489; 364/431.07

[56] References Cited

U.S. PATENT DOCUMENTS

| | | | |
|---|---|---|---|
| 4,463,730 | 8/1984 | Kishi | 123/492 |
| 4,490,792 | 12/1984 | Deutsch et al. | 123/492 |
| 4,523,571 | 6/1985 | Yamato et al. | 123/492 |
| 4,548,181 | 10/1985 | Ishikawa et al. | 123/492 |
| 4,561,405 | 12/1985 | Simdors | 123/492 |
| 4,616,619 | 10/1986 | Saito et al. | 123/492 |
| 4,627,404 | 12/1986 | Saito et al. | 123/492 |
| 4,633,841 | 1/1987 | Matsuura et al. | 123/492 |
| 4,635,200 | 1/1987 | Egami et al. | 123/492 |

*Primary Examiner*—Raymond A. Nelli

*Attorney, Agent, or Firm*—Michael J. Striker

[57] ABSTRACT

In a fuel injection system with an acceleration enrichment and a deceleration leaning, in which the transition compensation is determined by means of the throttle valve change speed in connection with the throttle valve change path. By means of the measurement of the throttle valve position the cause for the change of the air quantity is determined so that the information concerning a change of the operating state is present more quickly and a fuel leaning or fuel enrichment can accordingly also be effected more quickly. An intermediate injection threshold, which activates an intermediate injection calculation when exceeded, is built in, in addition, for the acceleration enrichment.

12 Claims, 2 Drawing Sheets

FUEL INJECTION SYSTEM

BACKGROUND OF THE INVENTION

The invention relates to a fuel injection system.

In all fuel injection systems, of both the digital and analog type, there are devices which influence the fuel-air mixture on the basis of changes in air quantity or air mass. The cause of these changes in air mass is the change of the throttle position. Accordingly, in these conventional devices, the effect, i.e. the change in air mass, and not the cause, i.e. the change in the throttle position, is used for the calculation for the triggering of the transition compensation. This has the disadvantage that the data concerning a change in the operating state is acquired after a time lag and, accordingly, the fuel enrichment or fuel leaning is effected with a delay.

SUMMARY OF THE INVENTION

It is an object of the invention to provide an injection system which has the advantage than there is a transition compensation which evaluates the throttle position change speed, and the cause for the resulting change in the air quantity is accordingly measured so that the fuel-air mixture composition can be influenced more rapidly.

An advantageous development of the injection system, according to the invention, consists in that the throttle position change travel above a throttle position change limiting speed is taken into account, in addition, so that small changes in the throttle travel at a high throttle position change speed, which occurs, for example, when playing with the gas pedal at a traffic light, are evaluated by the injection system differently than with simultaneously large throttle position change travel.

Another advantage is offered by the injection system, according to the invention, in that the control point of the transition compensation during the acceleration enrichment, which occurs when depressing the gas pedal, can be effected with a different control constant than during the deceleration leaning, which occurs when releasing the gas pedal.

For the acceleration enrichment there exists, in addition, a fuel-intermediate injection threshold which, when exceeded, activates an intermediate injection calculation so that additional fuel can be supplied between injections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 shows a block wiring diagram of the transition compensation of the injection system according to the invention. The transition compensation can be divided in principle into three parts.

Figure 1:
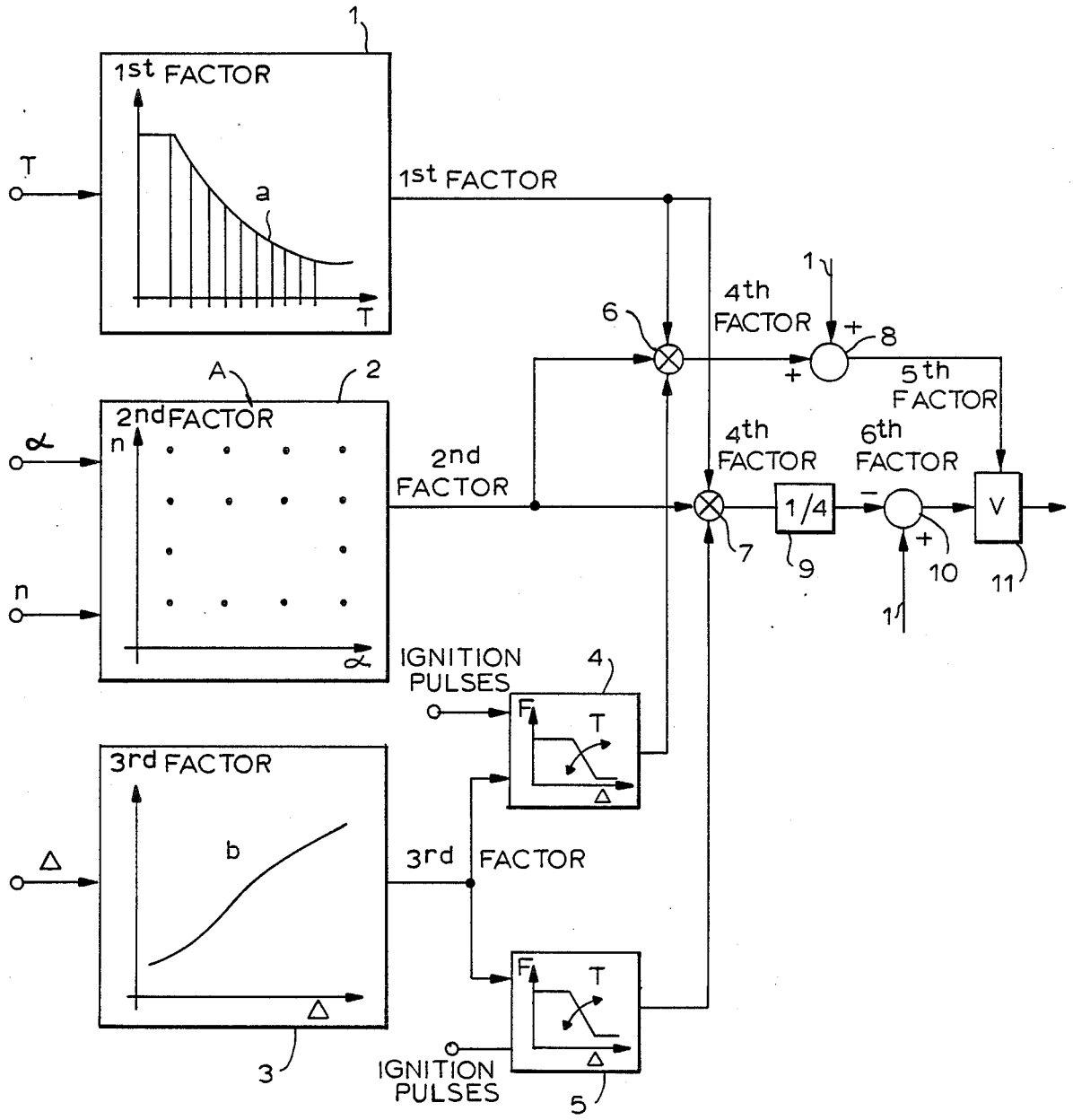
FIG. 1 shows a block wiring diagram of the transition compensation of the injection system according to the invention.

The first part 1 determines a first factor $FÜK_{MOT}$ by means of mathematical interpolation by way of a characteristic line a which is dependent on the engine temperature T and whose supporting points can be selected as desired.

The second part 2 determines a second factor $FÜK_{KF}$ from a three-dimensional characteristic diagram A, which factor $FÜK_{KF}$ is dependent on the throttle angle $\alpha$ and the speed n, wherein the supporting points of the characteristic diagram A can be selected as desired. The values of the factor $FÜK_{KF}$ range between 0.0 and 1.0.

The third part 3 determines a third factor $FÜK_{DEL}$ which is a function of the throttle position change speed $d\alpha/dt$ and the throttle position change travel $d\alpha$. The throttle position change speed $d\alpha/dt$ is determined in the 10 ms grid in the preferred embodiment form. The maximum time range for the identification of a transition compensation is 60 ms, wherein the identification thresholds of the transition compensation for the acceleration enrichment and the deceleration leaning can be selected separately.

The factor $FÜK_{DEL}$ is determined from a characteristic line b by means of the magnitude DELTA, which corresponds to the throttle position change speed $d\alpha/dt$ below a throttle position change limiting speed G and is calculated according to the equation $$\text{DELTA} = G + (d\alpha/dt - G)*K*d\alpha$$

with the inclusion of the throttle position change travel d when the throttle position change limiting speed G is exceeded, wherein K is a correction value. The factor $FÜK_{DEL}$, whose values are between 0.0 and 1.0, is controlled in control 4 during acceleration enrichment and in control 5 during deceleration leaning as a function of the ignition pulses ZI. The ignition pulses, which are a function of the operating point, are interpolated from the characteristic line which depends upon the engine temperature. The control point can be effected at different rates for the acceleration enrichment and for the deceleration leaning.

The factors $FÜK_{MOT}$, $FÜK_{KF}$ and $FÜK_{DEL}$ are supplied to a multiplication point 6 during acceleration enrichment and a multiplication point 7 during deceleration leaning. The fourth factor FP which is formed in the multiplication point 6 is supplied to a summing point 8 where the value 1 is added to the factor FP. On the other hand, the factor FP formed in the multiplication point 7 is reduced to one fourth part in the division point 9 in the preferred embodiment form and is then supplied to a subtraction point 10, where the fourth part of the factor FP is subtracted from the value 1.

The fifth factor $FÜK_1$ formed in the sixth summing point 8 and the factor $FÜK_2$ formed in the subtraction point 10 are supplied to a switching point 11 which has the factor $FÜK_1$ during acceleration enrichment and has the factor $FÜK_2$ during deceleration leaning as transition compensation factor FÜK.

Figure 2:
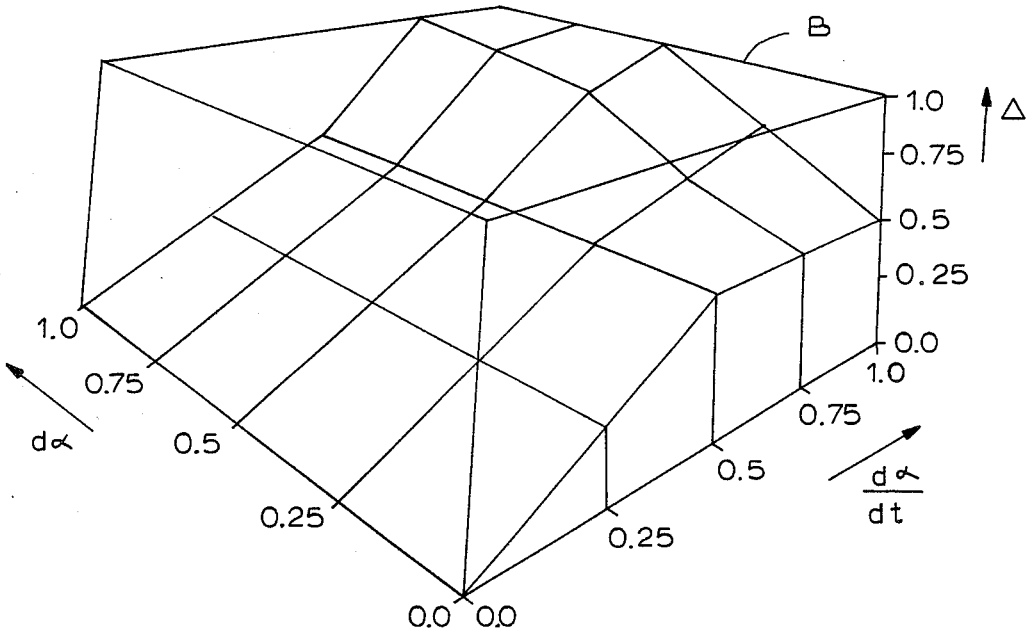
FIG. 2 shows a three-dimensional characteristic diagram for determining the magnitude DELTA.

FIG. 2 shows a three-dimensional characteristic diagram B which serves to determine the magnitude DELTA. The magnitude DELTA $\Delta$ is determined as a function of the throttle position change path $d\alpha$ and the throttle position change speed $d\alpha/dt$. The values of the magnitude DELTA, the throttle position change speed $d\alpha/dt$, and the throttle change path $d\alpha$ are between 0.0 to 1.0, respectively.

Figure 3:
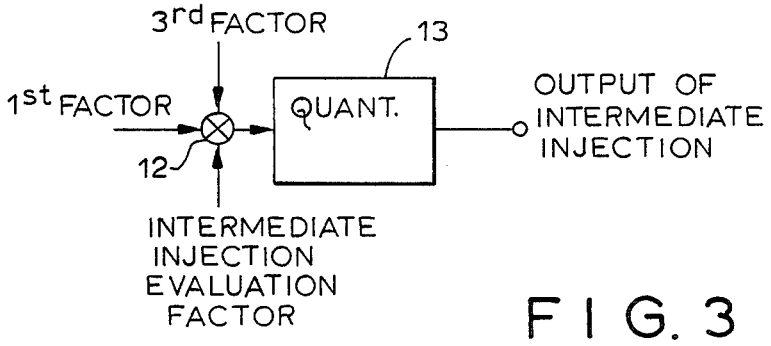
FIG. 3 shows a schematic presentation of the intermediate injection calculation.

FIG. 3 shows a schematic presentation of the intermediate injection calculation which is activated during the acceleration enrichment and when exceeding an intermediate injection threshold. The intermediate injection calculation is effected substantially by means of a multiplication point 12 and quantization device 13. The factor $FÜK_{MOT}$, the factor $FÜK_{DEL}$ and an intermediate injection evaluation factor KZW are supplied to the multiplication point 12. The value calculated in the multiplication point 12 is supplied to the quantization device 13, wherein the output of the intermediate injection ZWSP can be controlled in such a way that it is effected asynchronously relative to ignition, for example.

It will be understood that each of the elements described above, or two or more together, may also find a useful application in other types of fuel injection systems differing from the types described above.

While the invention has been illustrated and described as embodied in a fuel injection system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a fuel injection system which is able to operate with an acceleration enrichment to increase the fuel supply during an acceleration state and a deceleration leaning to reduce the fuel supply during a deceleration state, wherein a compensation of the fuel supply in dependence upon a throttle valve position and a throttle valve opening movement is obtained during a transient state from a normal operation for the acceleration enrichment or for the deceleration leaning, the improvement comprising means to determine a factor $FÜK_{DEL}$ which affects said compensation at the transient state, said fuel supply being loaded with said factor $FÜK_{DEL}$ which is derived from a three-dimensional characteristic diagram B as a function of a throttle valve position change speed $d\alpha/dt$ and a throttle valve change travel $d\alpha$.

2. Injection system according to claim 1, wherein a factor FP, which is taken into account for obtaining said compensation, is formed by forming the product of three different factors, wherein a first factor $FÜK_{MOT}$ is a function of an engine temperature, a second factor $FÜK_{KF}$ is a function of a throttle valve angle and the speed, and a third factor is said $FÜK_{DEL}$ factor.

3. Injection system according to claim 2, wherein the factor $FÜK_{MOT}$ is determined by means of a characteristic line (a) which is a function of the engine temperature.

4. Injection system according to claim 2, wherein the factor $FUK_{KF}$ is determined by means of a three-dimensional characteristic diagram (A), supporting points of which can be selected as desired, and the throttle valve angle and a speed n are each a coordination axis of the characteristic diagram (A).

5. Injection system according to claim 2, wherein the factor $FUK_{DEL}$ is determined from a characteristic line (b) by means of a magnitude DELTA.

6. Injection system according to claim 2, wherein the magnitude DELTA has the value of throttle valve position change speed $d\alpha/dt$, and wherein when a throttle position change limiting speed G is exceeded the throttle valve position change travel $d\alpha$ influences the magnitude DELTA according to the equation $$\text{DELTA}=G+(d\alpha/dt-G)\times K\times d\alpha,$$

wherein K is a correction factor.

7. Injection system according to claim 1, wherein identification thresholds of said compensation can be selected separately for the acceleration enrichment and the deceleration leaning.

8. Injection system according to claim 2, wherein the values of the factor $FÜK_{KF}$ and the factor $FÜK_{DEL}$ are between 0.0 and 1.0.

9. Injection system according to claim 2, wherein a factor $FUK_1$ representing the acceleration enrichment is the sum of the value 1 and the factor FP, and wherein a factor $FUK_2$ representing the deceleration leaning is the difference of the value 1 and a fourth of the factor FP.

10. Injection system according to claim 1, wherein said compensation can be controlled so as to be synchronous with ignition during the acceleration enrichment with a control point constant which is different than that during the deceleration leaning.

11. Injection system according to claim 1, wherein a calculation for fuel intermediate injection ZWSP is activated for the acceleration enrichment when a fuel intermediate injection threshold is exceeded, wherein the magnitude of the fuel-intermediate injection ZWSP is calculated from the equation $$ZWSP=FUK_{MOT}\times FUK_{DEL}\times KZW,$$

wherein KZW is an intermediate injection evaluation factor.

12. Injection system according to claim 3, wherein the factor $FÜK_{KF}$ is determined by means of a three-dimensional characteristic diagram (A), and throttle valve angle $\alpha$ and speed n are each a coordination axis of the characteristic diagram (A).

* * * * *